United States Patent [19]

Mazie et al.

[11] 4,154,420

[45] May 15, 1979

[54] CLOSET SHELF AND POLE ARRANGEMENT

[75] Inventors: Lowell I. Mazie, Huntingdon Valley; Paul V. Rucinski, Abington, both of Pa.; Vincent J. Pasquale, Cherry Hill, N.J.

[73] Assignee: Wessel Hardware Corporation, Philadelphia, Pa.

[21] Appl. No.: 880,649

[22] Filed: Feb. 23, 1978

[51] Int. Cl.[2] ..... A47F 5/00

[52] U.S. Cl. ..... 248/251; 108/29; 211/90; 248/235

[58] Field of Search ..... 248/251, 235; 108/29, 108/31; 211/90, 123, 105.1

[56] References Cited

U.S. PATENT DOCUMENTS

| | | | |
|---|---|---|---|
| 2,624,468 | 1/1953 | McCauley | 108/29 UX |
| 2,897,911 | 8/1959 | Bowers | 211/123 X |
| 2,960,761 | 11/1960 | Preader | 248/248 X |
| 3,081,882 | 3/1963 | Magnuson | 211/123 X |
| 3,669,395 | 6/1972 | Gehrke | 108/29 X |
| 3,990,582 | 11/1976 | Schindel | 248/251 X |

FOREIGN PATENT DOCUMENTS

| | | | |
|---|---|---|---|
| 801590 | 9/1958 | United Kingdom | 211/90 |
| 894811 | 4/1962 | United Kingdom | 211/123 |

*Primary Examiner*—J. Franklin Foss

*Attorney, Agent, or Firm*—Joseph G. Denny, III; Peter J. Patane

[57] ABSTRACT

An adaptor arm having a lower end portion supporting a pole and an opposite, upper end portion connected to a tubular shelf supporting bracket. The adaptor arm may have an opening to receive the pole or the adaptor arm may have a projecting lug supporting the pole. The adaptor arm may be inserted into the tubular shelf supporting bracket or may be placed around it.

13 Claims, 6 Drawing Figures

CLOSET SHELF AND POLE ARRANGEMENT

BACKGROUND OF THE INVENTION

This invention relates to supports for jointly supporting a shelf and a pole in a clothes closet.

There is a need for a system for arranging shelves and clothes poles within a closet which includes inexpensive hardware for supporting either a shelf by itself or (with an adaptor) both the shelf and a clothes pole.

There is also a need for hardware which may be easily installed to support the shelf and/or the clothes pole in a variety of arrangements.

BRIEF SUMMARY OF THE INVENTION

Thus, it is an object of this invention to provide an inexpensive tubular shelf support which may be combined with an adaptor arm to, in turn, support a clothes pole.

This invention provides an approximate right angle tubular shelf support having a front end for receiving the adaptor arm. The adaptor arm has an upper end portion connected to the front end of the shelf support. The adaptor arm has a depending lower end supporting the clothes pole.

The foregoing and other objects of the invention, the principles of the invention and the best modes in which I have contemplated applying such principles will more fully appear from the following description and accompanying drawings in illustration thereof.

BRIEF DESCRIPTION OF THE VIEWS

DESCRIPTION OF THE PREFERRED EMBODIMENTS

Figure 1:
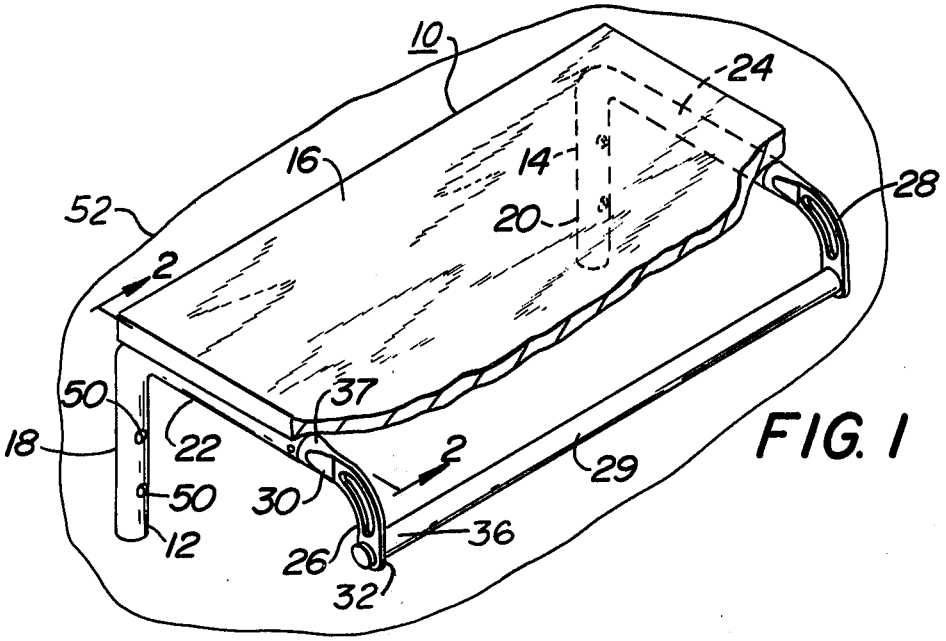
FIG. 1 is a front and top perspective view of two shelf supports, a shelf (partly cut away), two adaptor arms and a pole extending between the adaptor arms, the adaptor arms incorporating this invention.

Referring to the drawings, a combined shelf support and clothes pole support arrangement 10 is illustrated in FIG. 1 comprising two spaced shelf supports or brackets 12 and 14 upon which rests a shelf 16. The shelf supports 12 and 14 include vertical legs 18 and 20, respectively, and horizontal legs 22 and 24, respectively, the vertical and horizontal portions being integral.

Figure 2:
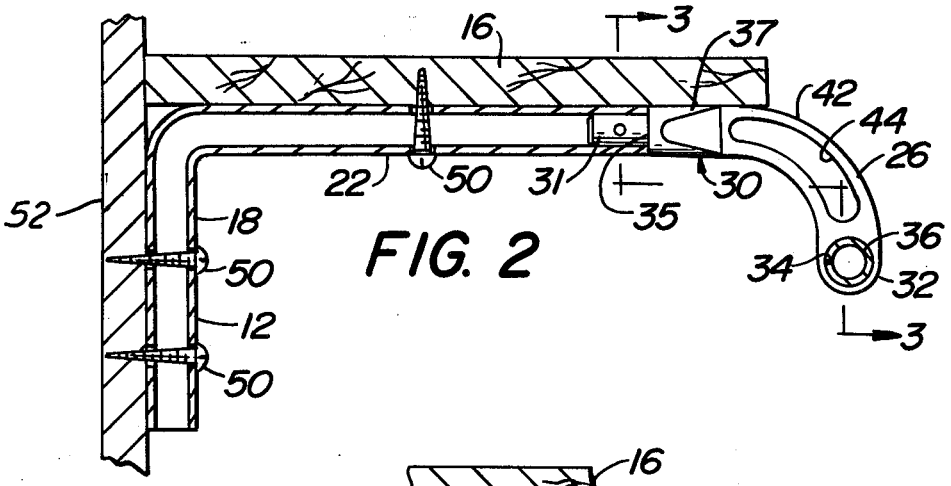
FIG. 2 is a cross sectional view taken along the line 2—2 in FIG. 1.
Figure 3:
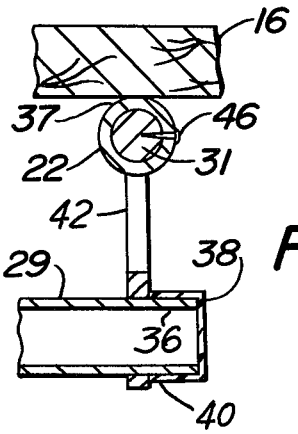
FIG. 3 is a cross sectional view taken along the line 3—3 in FIG. 2.
Figure 4:
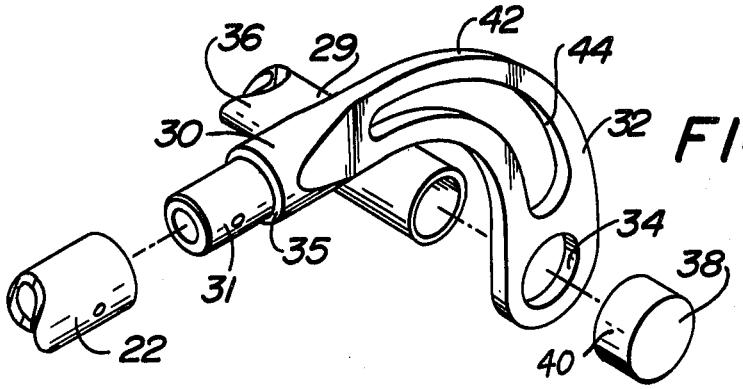
FIG. 4 is a top and back perspective view of one of the adaptor arms shown in FIG. 1 also showing an end cap for the pole and further showing portions of the pole and of a shelf support.

The shelf supports 12 and 14 are tubular in shape and have a circular cross section, as shown in FIG. 3. The vertical and horizontal legs 18 and 22 of the support 12, for example, are formed by bending a tubular member to the shape shown in FIGS. 1 and 2. While the cross section of the shelf supports 12 and 14 is circular, it will be understood that other cross sectional shapes such as square, rectangular or triangle, for example, could also be used.

Attached to the front or right hand end portions, as viewed in FIGS. 1 and 2, of the shelf supports 12 and 14 are adaptor arms 26 and 28, respectively, supporting a clothes pole or rod 29.

Only the adaptor arm 26 will hereinafter be described, it being understood that the adaptor arm 28 is substantially identical to it. The adaptor arm 26 has an upper portion 30 formed with an integral rearwardly extending lug 31 coupled to and interfitting with the front portion of the shelf support horizontal leg 22. The lug 31 has a cross section complementary with the interior shape of the horizontal leg 22, as shown in FIGS. 2 and 3, and is snugly received therein until the forward surface of the leg 22 abuts the shoulder 35. The upper portion 30 has an upper surface 37 with an outer diameter of approximately the same outer diameter as that of the horizontal leg 22, as shown in FIG. 2. Thus, a coupling is provided between the shelf support or bracket 12 and the adaptor arm 26 which underlies the shelf 16, is disposed at the forward end of the horizontal leg 22, abuts the underside of the shelf 16, and helps to support the shelf 16.

The adaptor arm 26 has a lower portion 32 formed with a circular hole 34 snugly receiving an end portion 36 of the pole 29, the end portion 36 extending through the lower portion 32 and being closed off by an end cap 38. The cap 38 tightly fits over the pole 29 and includes a peripheral portion 40 tending to limit axial movement of the pole 29. The lower portion is spaced sufficiently below the plane of the shelf 16 so as to support the clothes pole 29 sufficiently below the shelf 16 that it will be convenient for the user to place hooks or the like (not shown) upon the clothes pole 29.

The upper and lower portions 30 and 32 of the arm 26 are integrally connected by a downwardly curved midsection 42 having an arcuate shape, as shown, with an arcuate groove 44 to lighten its mass.

Preferably the interfitting portions of the horizontal leg 22 and of the upper portion 30 are provided with aligned holes through which extends a self tapping screw 46, FIG. 3, to secure them together.

As illustrated in FIGS. 1 and 2, the vertical and horizontal legs 18 and 22 of the shelf support 12 are provided with suitable holes through which extend screws 50 into the wall 52 and the shelf 16. The right hand shelf support 14 is also provided with similar holes and screws, but they are not illustrated.

Figure 5:
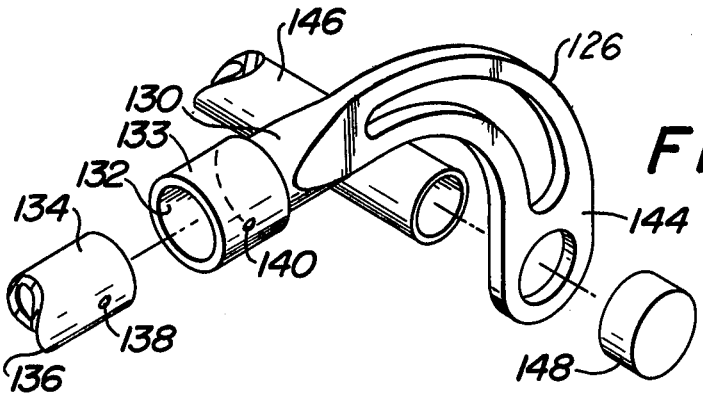
FIG. 5 is a view similar to FIG. 4, but showing a modification of the adaptor arm.

Referring to FIG. 5, an adaptor arm 126 is shown which is a modification of the adaptor bracket 26 shown in FIGS. 1 to 4.

The modified adaptor arm 126 of FIG. 5 has an upper end portion 130 formed with a well 132 which is defined by a socket 133 to snugly receive the forward end portion 134 of the shelf support 136. Aligned holes 138 and 140 receive a self tapping screw (not shown) to fasten the two parts to each other.

The lower portion 144 of the adaptor arm 126 is a similar to the corresponding portion of the arm 26 and receives a portion of a clothes pole 146 which in turn receives an end cap 148.

Figure 6:
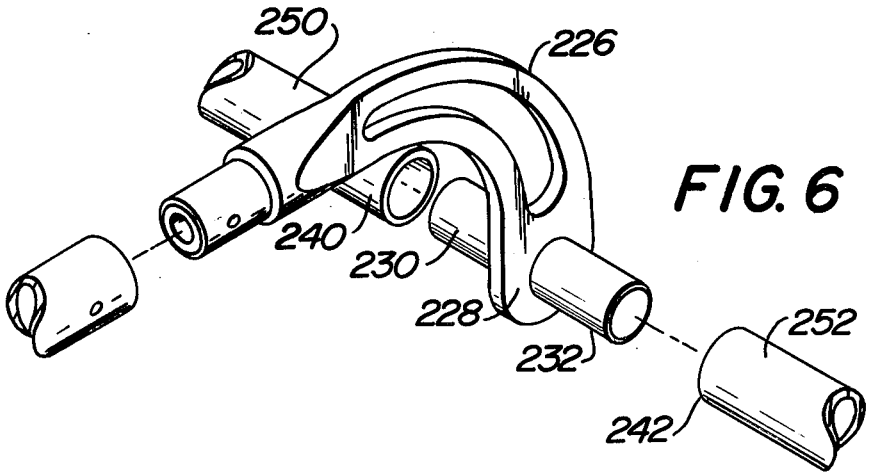
FIG. 6 is a view also similar to FIG. 4, but showing a further modification of the adaptor arm.

Referring to FIG. 6, an adaptor arm 226 is shown which is also modified relative to the adaptor bracket 26 shown in FIGS. 1 to 4. In the modification of FIG. 6 the lower portion 228 has axially aligned integral projecting lugs 230 and 232 on opposite sides, as shown, which snugly interfit with and extend into the end portions 240 and 242, respectively, of the clothes poles 250 and 252. The lugs 230 and 232 have a circular cross sectional shape mating with and complementary to the interior shapes of the end portions 240 and 242 and are snugly received within the latter to thereby support the poles 250 and 252.

Having described the invention, we claim:

1. A two-piece shelf support and adaptor arm assembly in combination with a shelf and a pole comprising an annular shelf support as a first piece having a generally vertical leg and a generally horizontal leg integral therewith, an annular pole circular in cross-section, an adaptor arm as a second piece having an upper portion with a cross section complementary to the cross section of said horizontal leg and interfitting therewith to connect said adaptor arm to said shelf support, said adaptor arm also having a lower portion spaced below said horizontal leg and interfitting with and supporting said annular pole, said upper portion of said adaptor arm snugly extending into said horizontal leg of said shelf support, said shelf support is circular in cross section and said upper portion of said adaptor arm is also circular in cross section, said lower portion of said adaptor arm having a circular opening into which snugly extends a portion of said annular pole to support the latter, a first means securing said shelf support and said upper portion of said adaptor arm to each other, and a second means securing said annular pole to said adaptor arm.

2. The combination of claim 1 wherein said upper portion of said adaptor arm includes a socket defining a well into which said horizontal leg of said shelf support snugly extends.

3. The combination of claim 1 wherein said lower portion of said adaptor arm has at least one outwardly extending lug which snugly extends into a portion of said annular pole to support the latter.

4. The combination of claim 2 wherein said lower portion of said adaptor arm has at least one outwardly extending lug which snugly extends into a portion of said annular pole to support the latter.

5. The combination of claim 2 wherein said well in said upper portion is also circular in cross section.

6. For use in a clothes closet with an annular shelf support having a generally vertical leg and a generally horizontal leg and an annular clothes pole, the improvement comprising an adaptor arm having an upper portion with a cross section complementary to the cross section of said horizontal leg and interfitting therewith to connect said adaptor arm to said shelf support, said adaptor arm also having a lower portion spaced below said horizontal leg and interfitting with and supporting said annular pole, said upper portion of said adaptor arm snugly extending into said horizontal leg of said shelf support, and said upper portion of said adaptor arm and said horizontal leg of said shelf support being both circular in cross section.

7. The combination of claim 6 wherein said upper portion of said adaptor arm includes a socket defining a well into which said horizontal leg of said shelf support snugly extends.

8. The combination of claim 6 wherein said lower portion of said adaptor arm has at least one outwardly extending lug which snugly extends into a portion of said annular pole to support the latter.

9. The combination of claim 7 wherein said lower portion of said adaptor arm has at least one outwardly extending lug which snugly extends into a portion of said annular pole to support the latter.

10. The combination of claim 7 wherein said well in said upper portion is also circular in cross section.

11. The combination of claim 6 wherein said upper portion of said adaptor arm has holes to receive a screw for securing the adaptor arm to said shelf support.

12. A shelf support and adaptor arm assembly for mounting a shelf and a pole to a wall comprising an annular shelf support having a generally vertical leg and a generally horizontal leg integral therewith, an annular pole, an adaptor arm having an upper portion with a cross section complementary to the cross section of said horizontal leg and interfitting therewith to connect said adaptor arm to said shelf support, said adaptor arm also having a lower portion spaced below said horizontal leg and interfitting with and supporting said annular pole, said upper portion of said adaptor having a lug snugly extending into said horizontal leg of said shelf support, said lower portion of said adaptor arm has at least one outwardly extending lug which snugly extends into a portion of said annular pole to support the latter, said shelf support is circular in cross section and said upper portion of said adaptor arm is also circular in cross section, and a screw extending through holes in said shelf support and said upper portion of said adaptor arm to secure them together.

13. A shelf support and adaptor arm assembly for mounting a shelf and a pole to a wall comprising an annular shelf support having a generally vertical leg and a generally horizontal leg integral therewith, an annular pole, an adaptor arm having an upper portion with a cross section complementary to the cross section of said horizontal leg and interfitting therewith to connect said adaptor arm to said shelf support, said adaptor arm also having a lower portion spaced below said horizontal leg and interfitting with and supporting said annular pole, said upper portion of said adaptor arm including a socket defining a well into which said horizontal leg of said shelf support snugly extends, said lower portion of said adaptor arm has at least one outwardly extending lug which snugly extends into a portion of said annular pole to support the latter, said shelf support is circular in cross section and said upper portion of said adaptor arm is also circular in cross section, said well in said upper portion is also circular in cross section, and a screw extending through holes in said shelf support and said upper portion of said adaptor arm to secure them together.

* * * * *